US006093110A

United States Patent [19]

Jones

[11] Patent Number: 6,093,110

[45] Date of Patent: Jul. 25, 2000

[54] GOLF TRAINING KIT

[76] Inventor: Robert Q. Jones, 2378 Greensward South, P.O. Box 250, Warrington, Pa. 18976-0250

[21] Appl. No.: 09/204,489

[22] Filed: Dec. 3, 1998

[51] Int. Cl.[7] ..... A63B 57/00

[52] U.S. Cl. ..... 473/218; 473/219; 473/270; 473/272; 473/273; 473/265

[58] Field of Search ..... 473/219, 218, 473/270, 272, 273, 268, 257, 265, 409, 176, 179, 238; 273/DIG. 30

[56] References Cited

U.S. PATENT DOCUMENTS

| | | | |
|---|---|---|---|
| 3,920,248 | 11/1975 | Medders | 273/186 |
| 4,017,084 | 4/1977 | Jeffery | 273/176 FB |
| 4,146,231 | 3/1979 | Merkle et al. | 273/187 R |
| 4,244,576 | 1/1981 | Mosier et al. | 273/176 F |
| 4,358,116 | 11/1982 | Florida | 273/177 R |
| 4,583,739 | 4/1986 | Kabbany | 273/187 R |
| 4,871,175 | 10/1989 | Levin et al. | 273/187 R |
| 5,108,106 | 4/1992 | Cook | 273/187 R |
| 5,301,947 | 4/1994 | Kim | 273/176 H |
| 5,316,292 | 5/1994 | Browne | 273/34 R |
| 5,362,060 | 11/1994 | Hinson | 273/187 R |
| 5,437,458 | 8/1995 | Springer | 273/192 |
| 5,897,442 | 4/1999 | Honderd | 473/218 |
| 5,947,832 | 9/1999 | Gagne | 473/217 |

*Primary Examiner*—Jessica J. Harrison
*Assistant Examiner*—Minh Trinh

[57] ABSTRACT

A golf training kit for helping a golfer improve his or her overall game by helping improve alignment, putting stroke, pitching and chipping, and ball position. The inventive device includes a circular target, a line and putting guide, a putter trainer guide, a golf hole backstop that is positionable within a golf hole, an alignment guide that is adapted for illustrating proper ball placement for various shots, and an indoor putting ring adapted for securement to a carpeted surface.

9 Claims, 4 Drawing Sheets

GOLF TRAINING KIT

BACKGROUND OF THE INVENTION

1. Field of the Invention

The present invention relates to training kits and more particularly pertains to a new golf training kit for helping a golfer improve alignment, putting stroke, pitching and chipping, and ball positions.

2. Description of the Prior Art

The use of training kits is known in the prior art. More specifically, training kits heretofore devised and utilized are known to consist basically of familiar, expected and obvious structural configurations, notwithstanding the myriad of designs encompassed by the crowded prior art which have been developed for the fulfillment of countless objectives and requirements.

Known prior art include U.S. Pat. No. 5,294,125; U.S. Pat. No. 5,308,070; U.S. Pat. No. Des. 353,432; U.S. Pat. No. 5,190,284; U.S. Pat. No. 4,925,192; U.S. Pat. No. 5,441,267; U.S. Pat. No. 1,540,350; U.S. Pat. No. 3,176,991; U.S. Pat. No. 3,216,728; U.S. Pat. No. 3,464,704; U.S. Pat. No. 3,540,734; U.S. Pat. No. 3,584,877; U.S. Pat. No. 4,358,116; U.S. Pat. No. 5,409,231; U.S. Pat. No. 5,441,267; U.S. Pat. No. 5,692,963; and U.S. Pat. No. 5,779,567.

While these devices fulfill their respective, particular objectives and requirements, the aforementioned patents do not disclose a new golf training kit. The inventive device includes a circular target, a line and putting guide, a putter trainer guide, a golf hole backstop that is positionable within a golf hole, an alignment guide that is adapted for illustrating proper ball placement for various shots, and an indoor putting ring adapted for securement to a carpeted surface.

In these respects, the golf training kit according to the present invention substantially departs from the conventional concepts and designs of the prior art, and in so doing provides an apparatus primarily developed for the purpose of helping a golfer improve alignment, putting stroke, pitching and chipping, and ball positions.

SUMMARY OF THE INVENTION

In view of the foregoing disadvantages inherent in the known types of training kits now present in the prior art, the present invention provides a new golf training kit construction wherein the same can be utilized for helping a golfer improve alignment, putting stroke, pitching and chipping, and ball positions.

The general purpose of the present invention, which will be described subsequently in greater detail, is to provide a new golf training kit apparatus and method which has many of the advantages of the training kits mentioned heretofore and many novel features that result in a new golf training kit which is not anticipated, rendered obvious, suggested, or even implied by any of the prior art training kits, either alone or in any combination thereof.

To attain this, the present invention generally comprises a circular target, a line and putting guide, a putter trainer guide, a golf hole backstop that is positionable within a golf hole, an alignment guide that is adapted for illustrating proper ball placement for various shots, and an indoor putting ring adapted for securement to a carpeted surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf training kit apparatus and method which has many of the advantages of the training kits mentioned heretofore and many novel features that result in a new golf training kit which is not anticipated, rendered obvious, suggested, or even implied by any of the prior art training kits, either alone or in any combination thereof.

It is another object of the present invention to provide a new golf training kit which may be easily and efficiently manufactured and marketed.

It is a further object of the present invention to provide a new golf training kit which is of a durable and reliable construction.

An even further object of the present invention is to provide a new golf training kit which is susceptible of a low cost of manufacture with regard to both materials and labor, and which accordingly is then susceptible of low prices of sale to the consuming public, thereby making such golf training kit economically available to the buying public.

Still yet another object of the present invention is to provide a new golf training kit which provides in the apparatuses and methods of the prior art some of the advantages thereof, while simultaneously overcoming some of the disadvantages normally associated therewith.

Still another object of the present invention is to provide a new golf training kit for helping a golfer improve alignment, putting stroke, pitching and chipping, and ball positions.

Yet another object of the present invention is to provide a new golf training kit which includes a circular target, a line and putting guide, a putter trainer guide, a golf hole backstop that is positionable within a golf hole, an alignment guide that is adapted for illustrating proper ball placement for various shots, and an indoor putting ring adapted for securement to a carpeted surface.

Still yet another object of the present invention is to provide a new golf training kit that may be used both indoors and outdoors.

Even still another object of the present invention is to provide a new golf training kit in which many of the parts fold up or may be disassembled for more convenient transportation and storage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
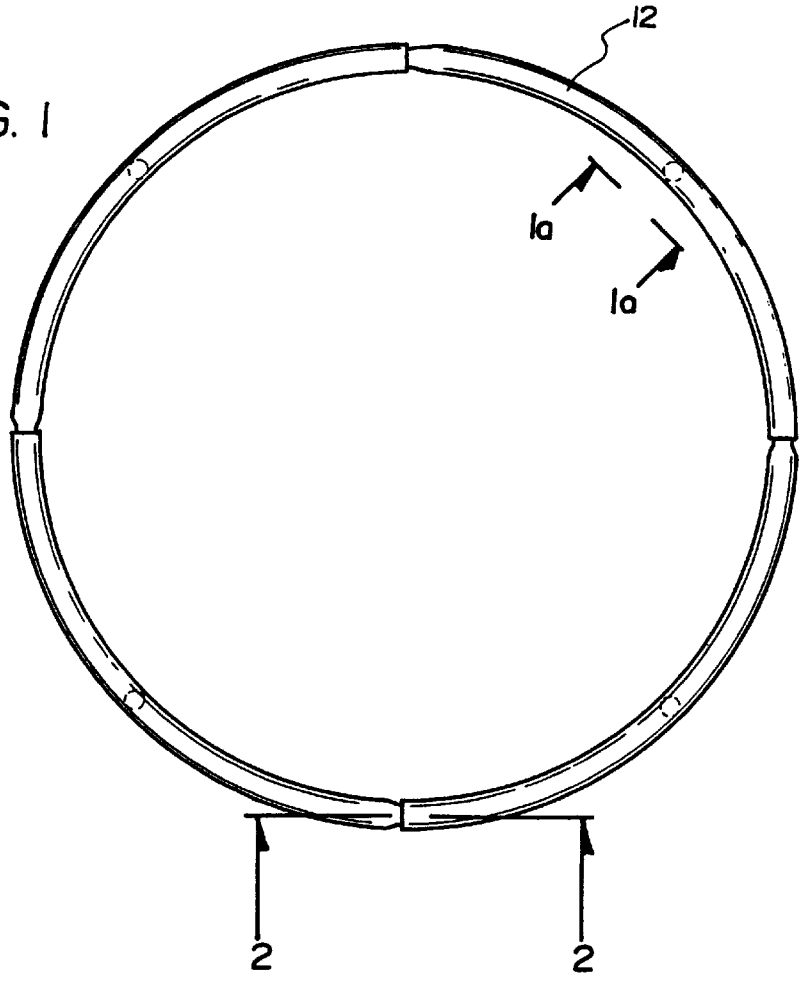
FIG. 1 is a top plan view of a circular target of a new golf training kit according to the present invention.
Figure 1A:
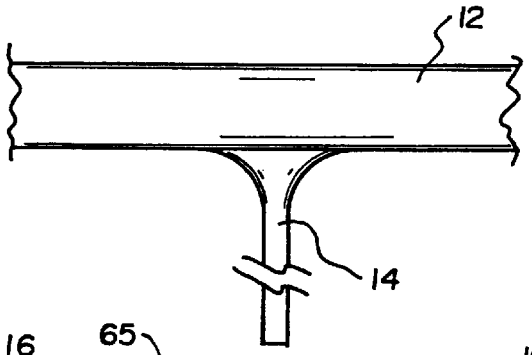
FIG. 1*a* is a side view of the circular target of the present invention as taken along line 1*a*—1*a* of FIG. 1.

With reference now to the drawings, and in particular to FIGS. 1 through 8 thereof, a new golf training kit embodying the principles and concepts of the present invention and generally designated by the reference numeral 10 will be described.

As best illustrated in FIGS. 1 through 8, the golf training kit 10 comprises a circular target 12 comprised of a telescoping peripheral frame for adjusting a diameter of the circular target 12. The circular target 12 has a plurality of legs 14 extending downwardly therefrom for elevating the circular target 12 above a recipient surface. The legs ideally have flat tips, but may also have pointed tips. The circular target 12 is raised off of the ground by the legs 14 so that the ball can pass under it, but the main purpose of the circular target 12 is to practice chipping, pitching, and putting golf balls under the circular target 12 to the cup to maximize a consistent and repetitive "up and down.".

Figure 2:
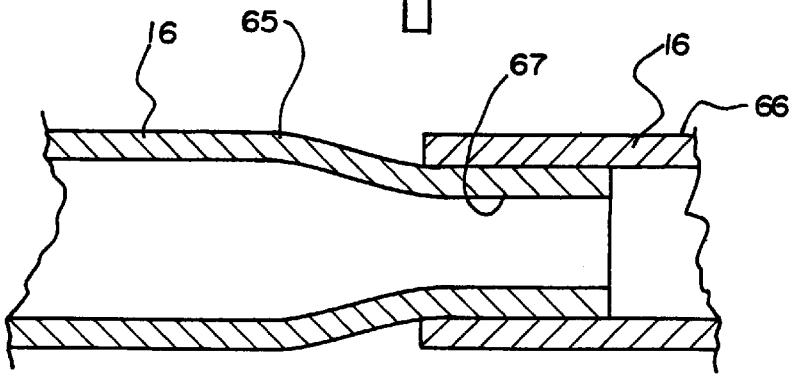
FIG. 2 is a cross-sectional view of the present invention as taken along line 2—2 of FIG. 1.

Preferably, as shown in FIGS. 1 and 2, the telescoping peripheral frame comprises a plurality of separable tubular segments 16. Each of the segments has a male end 65 and a female end 66 that allow for it to be broken down for storage and transport. The male ends 65 are slidably insertable in the female ends 66 and are positionable in the female ends 66 along a length of the tapered portion 67 of the male ends 65. The male ends 65 are slid all the way into the female ends 66 for a normal diameter of the circular target.

In an exemplary embodiment of the circular target, the peripheral frame has four tubular segments 16 each having an outer diameter of between ½ and 1½ inches, ideally ¾ inch. The inner diameter of the peripheral frame with all of the male ends of the segments fully inserted is between about 30 and 60 inches, ideally 42 inches. The length of the tapered portions of each of the male ends of the segments is between about 1 and 6 inches, ideally 2 inches. The length of each of the legs is between about 1 and 6 inches, ideally 3 inches.

Figure 3:
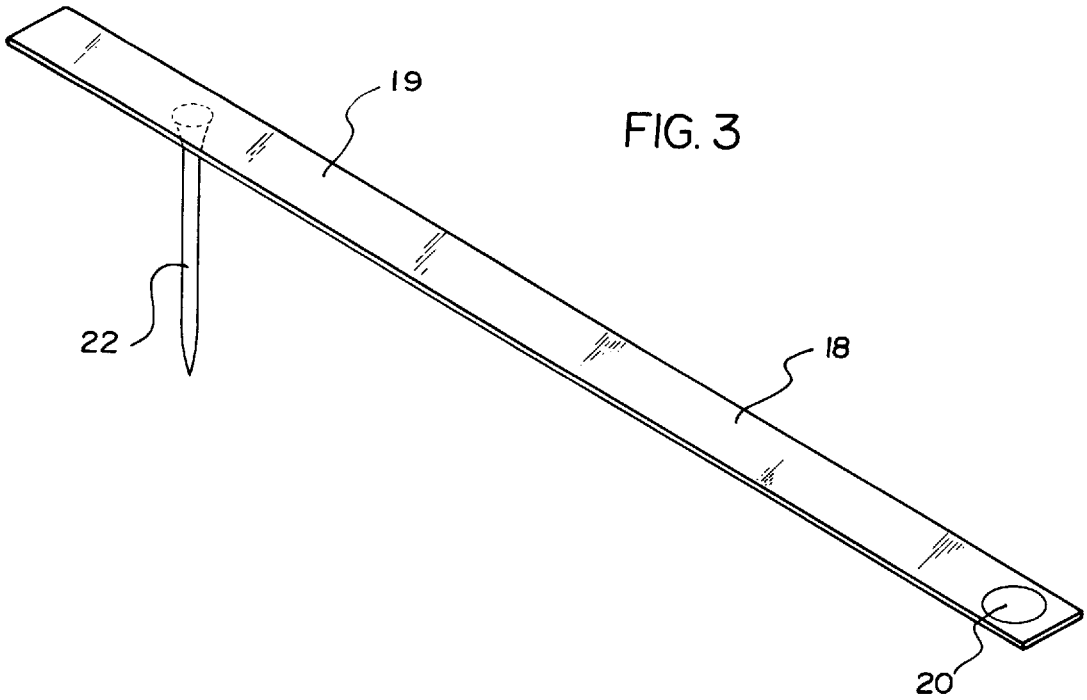
FIG. 3 is a perspective view of a line and putting guide of the present invention.

As shown in FIG. 3, a line and putting guide 18 is provided comprising an elongated strip 19 having a first end and a second end. The first end has a ball mark 20 disposed thereon. The second end has a long spike 22 extending downwardly therefrom and removably coupled thereto for securement of the strip 18 to a recipient surface. The spike 22 is inserted into the recipient surface and the strip 19 is positioned inline with a target, such as a golf hole or the circular target 12, with the ball mark 20 being positioned towards the target. The ball mark 20 indicates where the golf ball should be positioned for practice, and the golf ball is placed under the ball mark 20. As a golfer strokes at the golf ball, he or she strokes the head of the club under the strip 19, using the strip 19 as a guide to line up the club with the golf ball as well as to stroke the club straight to hit the ball straight towards the target. The golfer aligns his or her feet parallel to strip 19, which points out the line.

In an exemplary embodiment of the line and putting guide 18, the length of the elongated strip 19 between the first and second ends is between about 12 and 36 inches, ideally 24 inches. The width of the strip is between about ⅓ and 1 inch wide, ideally ¾ inch wide. The height of the strip is between about 1/16 and ½ inch high, ideally ¼ inch high. The length of the spike 22 is about 6 inches and is positioned about four inches from the second end. Ideally, the strip is constructed of clear plastic.

Figure 4:
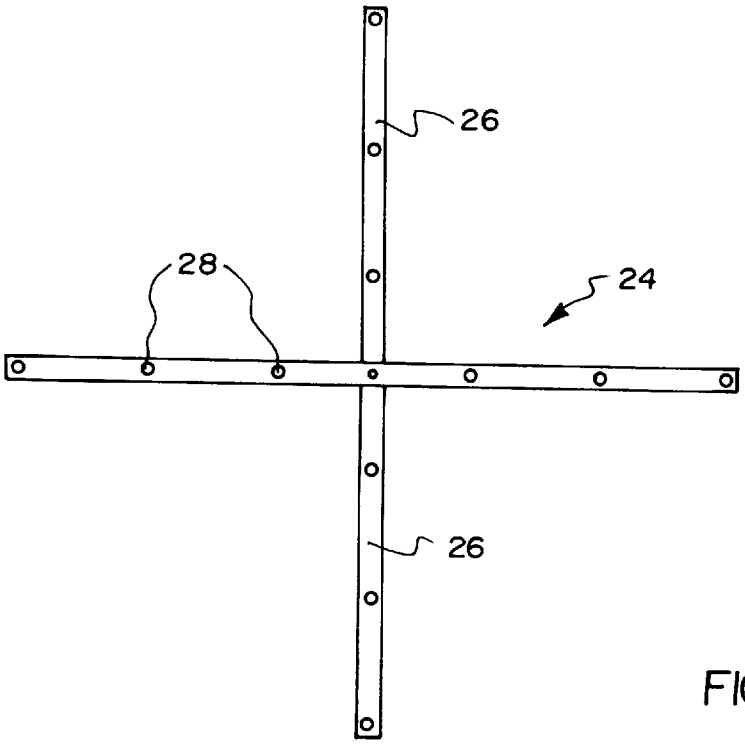
FIG. 4 is a plan view of a putter trainer guide of the present invention.

As shown in FIG. 4, a putter trainer guide 24 is provided comprising a pair of criss-crossing strips 26. The crisscrossing strips 26 each have incremental ball markers 28 disposed thereon in a spaced relationship for approximating the distance of a golf ball from a golf hole. The putter trainer guide 24 is positionable over a golf hole and a golf ball is placed on a surface, such as a green, a short distance from the hole and the distance between the ball and the hole is estimated from the incremental ball markers 28. The ball is putted towards the hole. By repeating this procedure at varying distances from the hole, a golfer can determine at which distances he or she has trouble making the shot. The golfer can consistently repeat the shot at those distances to improve his or her shots.

In an exemplary embodiment, each of the criss-crossing strips 26 comprises a pair of opposed half strips pivotally coupled together at by a rivet such that the four half strips may be selectively aligned for more convenient transportation and storage. The length of each of the half strips is between about 12 and 72 inches, ideally 38 inches. The width of the criss-crossing strips 26 is between about ¼ and 1 inch, ideally ¾ inch and the height is between about 1/32 and ¼ inches, ideally about 3/32 inch high. The incremental ball markers 28 are disposed at one foot intervals.

Figure 5:
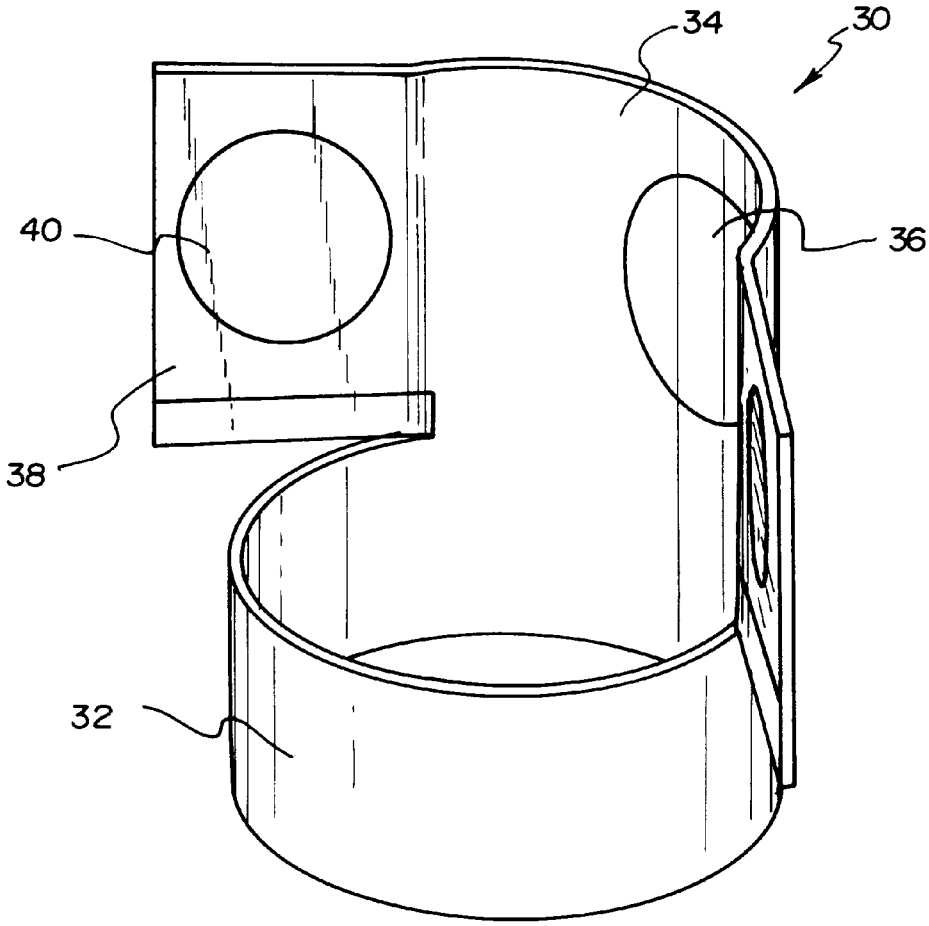
FIG. 5 is a perspective view of a backstop for golf hole cup of the present invention.
Figure 6:
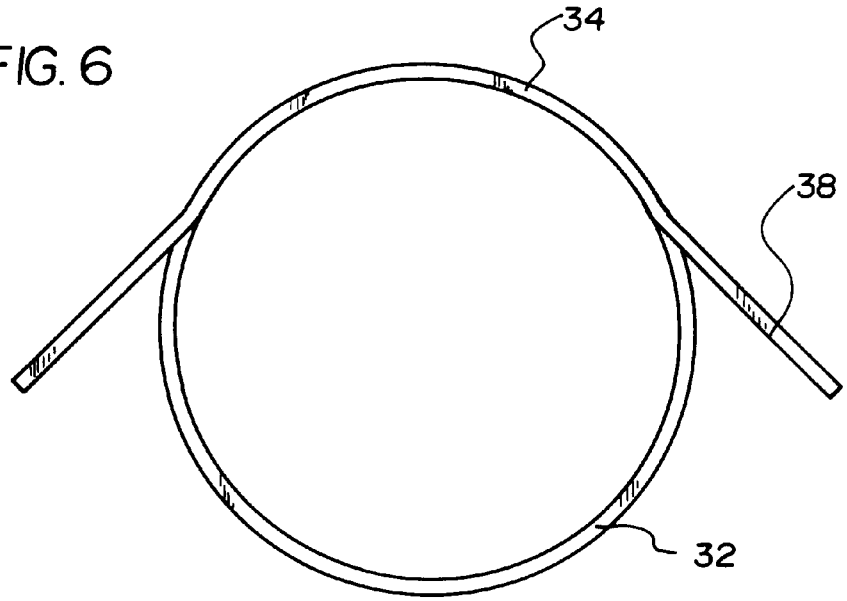
FIG. 6 is a plan view of the backstop golf hole cup of the present invention.

As shown in FIGS. 5 and 6, a golf hole backstop 30 is provided that is positionable within a golf hole. The backstop 30 includes a cylindrical ring 32 dimensioned for being received within the golf hole. The backstop 30 further includes an arcuate panel 34 extending upwardly from an upper edge of the cylindrical ring 32. The arcuate panel 34 has a target 36 marked thereon. The arcuate panel 34 has a pair of side panels 38 extending outwardly from opposed side edges thereon at about a 45 degree angle. The side panels 38 each have a target 40 marked thereon. The marks 36,40 on the arcuate panel 34 and the side panels 38 provide directional points for the golfer to aim as he/she putts.

In an exemplary embodiment, the outer diameter of the cylindrical ring is about 3⅞ inches and the height of the cylindrical ring is between about 1 and 4 inches, ideally 2½ inches. The vertical height of each of the side panels 38 is between about 2 and 6 inches, ideally 4½ inches. The thickness of the cylindrical ring and panels of the golf hole backstop 30 is between about 1/32 and ¼ inch, ideally 3/32 inch.

Figure 7:
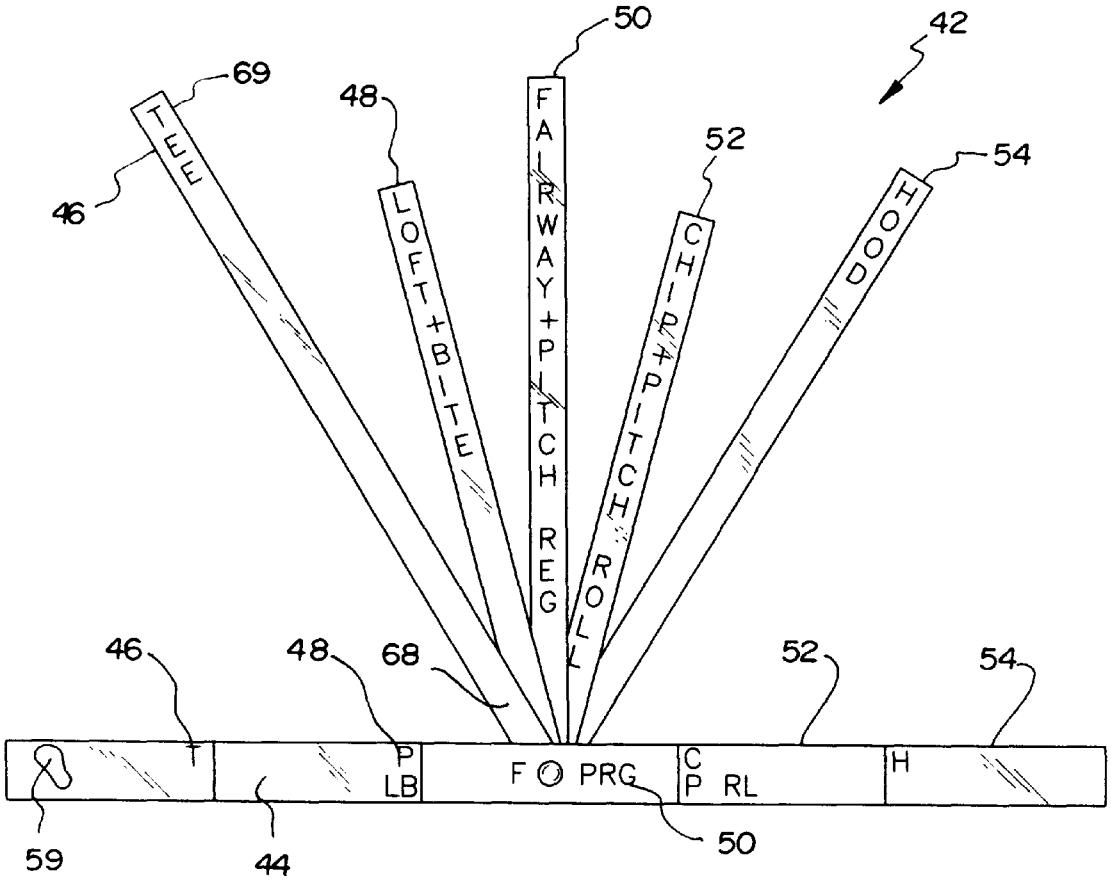
FIG. 7 is a plan view of a multi-shot alignment guide of the present invention.

As shown in FIG. 7, an alignment guide 42 is provided that is adapted for illustrating proper foot placement for various shots including a tee shot 46, pitch and chip shots that bite 48, fairway shots and regular pitch shots 50, chip and pitch shots that roll 52, and hooded shots 54. The alignment guide includes a linear strip 44 having foot indicia 59 thereon for indicating where the foot of a golfer should be placed. The linear strip 44 also has precisely placed indicia thereon corresponding to particular golf shots. The indicia is lined up with the ball to indicate the proper placement of a golfer's leading foot with respect to the ball when executing various golf shots that correspond to the indicia. A plurality of shot strips 46–54 are pivotally coupled at their proximal ends 68 to the linear strip 44 by a rivet, each shot strip corresponding to one of the golf shot indicia of the linear strip 44. Each of the distal ends 69 of the shot strips 46–54 are positioned on a distinct line extending perpendicularly to the linear strip 44 and extending through a corresponding set of indicia, as shown in FIG. 7.

When using the alignment guide 42, a golfer pivots a shot strip, corresponding to the shot the golfer currently wants to make, to the proper position and places a ball at the distal end of the shot strip. A right handed golfer places his left foot on the foot indicia. For example, a golfer teeing off would lay the alignment guide down on the grass and place his or her left foot on the foot indicia and position the distal end of the shot strip 46 corresponding to tee shots on a line extending perpendicularly to the linear strip 44 and extending through the indicia representing the teeing position, as shown by a "T" in FIG. 7. For a left handed golfer, the alignment guide 42 is merely turned over and his or her right foot is placed over the foot indicia. Ideally, the alignment guide is made of clear plastic so that the same indicia can be seen on both sides.

In an exemplary embodiment of the alignment guide 42, the linear strip 44 is between about 20 and 36 inches long, ideally 26 inches long. The shot strip 46 corresponding to a tee shot is between about 24 and 40 inches long, ideally 31 inches long. The shot strip 48 corresponding to pitch and chip shots that bite is between about 12 and 30 inches long, ideally 22 inches long. The shot strip 50 corresponding to fairway shots and regular pitch shots is between about 24 and 36 inches long, ideally 29 inches long. The shot strip 52 corresponding to chip and pitch shots that roll is between about 12 and 30 inches long, ideally 21 inches long. The shot strip 54 corresponding to hooded shots is between about 20 and 30 inches long, ideally 25 inches long.

Figure 8:
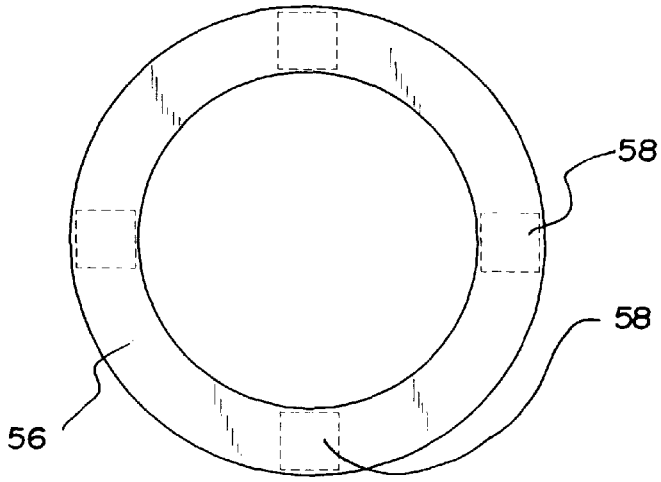
FIG. 8 is a plan view of an indoor putting ring of the present invention.

As shown in FIG. 8, an indoor putting ring 56 is provided having a plurality of hook and loop fasteners 58 disposed on a lower surface thereof for securement to a carpeted surface. In an exemplary embodiment, the width of the indoor putting ring 56 between inner and outer peripheries thereof is about one inch. The diameter of the inner periphery is about 4½ inches.

In use, the circular target 12 is placed on a surface such as the ground and the legs 14 holding the circular target 12 above the surface.

To practice chipping, the alignment guide 42 is placed on the ground and one of the shot strips 48–52 corresponding to chipping is properly positioned. Which shot strip used depends on which type of chipping is wished to be practiced. The golfer places his or her leading foot on the foot indicia of the alignment guide. The alignment guide teaches proper positioning of the leading foot of the golfer with respect to the golf ball.

To practice long distance putting, the golf hole backstop 30 is laced in a golf hole. The line and putting guide 18 is placed in alignment with the golf hole backstop 30. A golf ball is placed under the ball mark 20 of the line and putting guide. The line and putting guide provides a visual guide for properly stroking the putter in the correct direction to hit the ball towards the golf hole backstop 30.

To practice short distance putting, the same general procedure is used as for practicing long distance putting, except that one section of the putter training guide 24 is placed over the golf hole backstop 30 or the indoor putting ring 56. The golfer can estimate the approximate distance of the ball from the hole by making visual reference to the incremental ball markers 28.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf training kit for helping a golfer improve his or her overall game by helping improve alignment, putting stroke, pitching and chipping, and ball position, the golf training kit comprising, in combination:

a circular target comprising a telescoping peripheral frame;

the peripheral frame of the circular target comprising a plurality of separable tubular segments, each of the segments having a male end and a female end, wherein the male ends having tapered portions being slidably insertable in the female ends, the male ends being positionable in the female ends along a length of the tapered portion of the male end;

the circular target having a plurality of legs extending downwardly therefrom for elevating the circular target above a recipient surface, wherein each of the segments has one leg extending therefrom;

a line and putting guide for helping line up the stroke of a golf club with a golf ball when hitting the golf ball towards the circular target, the line and putting guide being rested on the recipient surface and comprising an elongated strip having a first end and a second end, the first end having a ball mark disposed thereon, the second end having a long spike extending downwardly therefrom for securement of the strip to the recipient surface;

a golf hole backstop for helping practice putting, the golf hole backstop being positionable within a golf hole in the recipient surface and being spaced apart from the circular target, the backstop including a cylindrical ring dimensioned for being received within the golf hole, the backstop further including an arcuate panel extending upwardly from an upper edge of the cylindrical ring, the arcuate panel having a target marked thereon, the arcuate panel having a pair of side panels extending outwardly from opposed side edges thereon at about a 45 degree angle, the side panels each having a target marked thereon;

a putter trainer guide for approximating the distance of a golf ball from the golf hole in the recipient surface, the putter trainer guide comprising a pair of criss-crossing strips, the criss-crossing strips each having incremental ball marks disposed thereon in a spaced relationship, the putter trainer guide being positionable over the golf hole;

an alignment guide adapted for illustrating proper foot placement for various shots when hitting the ball, the alignment guide including a linear strip having foot indicia for indicating where a foot of a golfer should be placed, the linear strip having golf shot indicia thereon for lining up with the ball for various golf shots, the various golf shots including a tee shot, pitch and chip shots that bite, fairway shots and regular pitch shots, chip and pitch shots that roll, and hooded shots;

the alignment guide having a plurality of shot strips being pivotally coupled at proximal ends thereof to the linear strip by a rivet, each shot strip corresponding to one of the golf shot indicia of the linear strip, each of the distal ends of the shot strips being positioned on a distinct line extending perpendicularly to the linear strip and extending through a corresponding set of golf shot indicia; and an indoor putting ring being rested on the recipient surface and being spaced apart from the circular target, the indoor putting ring having a plurality of hook and loop fasteners disposed on a lower surface thereof for securement to a carpeted surface.

2. A golf training kit for helping a golfer improve his or her overall game by helping improve alignment, putting stroke, pitching and chipping, and ball position, the golf training kit comprising, in combination:

a circular target;

a line and putting guide for helping line up the swing of a golf club with a golf ball when hitting the golf ball towards the circular target, the line and putting guide being rested on the recipient surface and comprising an elongated strip having a first end and a second end, the first end having a ball mark disposed thereon, the second end having a long spike extending downwardly therefrom for securement of the strip to the recipient surface;

a golf hole backstop for helping practice putting, the golf hole backstop being positionable within the golf hole in the recipient surface and being spaced apart from the circular target, the backstop including a cylindrical ring dimensioned for being received within the golf hole, the backstop further including an arcuate panel extending upwardly from an upper edge of the cylindrical ring, the arcuate panel having a target marked thereon; and wherein the arcuate panel has a pair of side panels extending outwardly from opposed side edges thereon, the side panels each having a target marked thereon.

3. The golf training kit as set forth in claim 2, wherein the circular target comprises a telescoping peripheral frame for permitting disassembly of the circular target for easier portability.

4. The golf training kit as set forth in claim 3, wherein the peripheral frame of the circular target comprising a plurality of separable tubular segments, each of the segments having a male end and a female end, wherein the male ends having tapered portions being slidably insertable in the female ends, the male ends being positionable in the female ends along a length of the tapered portion of the male end.

5. The golf training kit as set forth in claim 2, wherein the circular target has a plurality of legs extending downwardly therefrom for elevating the circular target above a recipient surface.

6. The golf training kit as set forth in claim 2, further comprising a putter trainer guide for approximating the distance of a golf ball from a golf hole in the recipient surface, the putter trainer guide comprising a pair of criss-crossing strips, the crisscrossing strips each having incremental ball marks disposed thereon in a spaced relationship, the putter trainer guide being positionable over the golf hole.

7. The golf training kit as set forth in claim 2, further comprising an alignment guide adapted for illustrating proper foot placement for various shots when hitting the ball towards the circular target, the alignment guide resting on the recipient surface and being spaced apart from the circular target, the alignment guide including a linear strip having foot indicia for indicating where a foot of a golfer should be placed with respect to the ball, the linear strip having golf shot indicia thereon for lining up with the ball for various golf shots, the various golf shots including a tee shot, pitch and chip shots that bite, fairway shots and regular pitch shots, chip and pitch shots that roll, and hooded shots.

8. The golf training kit as set forth in claim 7, wherein the alignment guide has a plurality of shot strips being pivotally coupled at proximal ends thereof to the linear strip by a rivet, each shot strip corresponding to one of the golf shot indicia of the linear strip, each of the distal ends of the shot strips being positioned on a distinct line extending perpendicularly to the linear strip and extending through a corresponding set of golf shot indicia.

9. The golf training kit as set forth in claim 2, further comprising an indoor putting ring being rested on the recipient surface and being spaced apart from the circular target, the indoor putting ring having a plurality of hook and loop fasteners disposed on a lower surface thereof for securement to a carpeted surface.

* * * * *